US007175749B2

(12) United States Patent
Delclos et al.

(10) Patent No.: US 7,175,749 B2
(45) Date of Patent: Feb. 13, 2007

(54) METHOD AND DEVICE FOR DETECTING ANODE EFFECTS OF AN ELECTROLYTIC CELL FOR ALUMINUM PRODUCTION

(75) Inventors: Christian Delclos, Meylan (FR); Olivier Bonnardel, Vlissingen (NL)

(73) Assignee: Aluminum Pechiney, Paris (FR)

( * ) Notice: Subject to any disclaimer, the term of this patent is extended or adjusted under 35 U.S.C. 154(b) by 423 days.

(21) Appl. No.: 10/498,027

(22) PCT Filed: Dec. 4, 2002

(86) PCT No.: PCT/FR02/04163

§ 371 (c)(1),
(2), (4) Date: Jun. 7, 2004

(87) PCT Pub. No.: WO03/048426

PCT Pub. Date: Jun. 12, 2003

(65) Prior Publication Data

US 2005/0067298 A1 Mar. 31, 2005

(30) Foreign Application Priority Data

Dec. 7, 2001 (FR) ..... 01 15871

(51) Int. Cl.
*C25C 3/20* (2006.01)

(52) U.S. Cl. ..... 205/336; 205/335; 205/376; 205/389; 205/392; 204/243.1; 204/247.1

(58) Field of Classification Search ..... 205/336, 205/335, 376, 389, 392; 204/243.1, 247.1
See application file for complete search history.

(56) References Cited

U.S. PATENT DOCUMENTS 3,888,747 A * 6/1975 Murphy ..... 205/336

(Continued)

FOREIGN PATENT DOCUMENTS

FR 2 749 858 12/1997

(Continued)

OTHER PUBLICATIONS

Database WPI, Section Ch, Week 198948, Derwent Publications Ltd., London, GB; Class M28, AN 1989-355325, XP002211086.

(Continued)

*Primary Examiner*—Bruce F. Bell
(74) *Attorney, Agent, or Firm*—Susan E. Shaw McBee

(57) ABSTRACT

Process for early detection of an anode effect in an aluminum production cell based on molten salt electrolysis. The cell comprises at least one anode, at least one cathode and cathode connecting conductors and anode connecting conductors. The process comprises:

measurement of a first electrical voltage signal U1 between a first cathode measurement point on a cathode connecting conductor and a first anode measurement point on an anode connecting conductor;

measurement of at least one second electrical voltage signal U2 between a second cathode measurement point on a cathode connecting conductor and a second anode measurement point on an anode connecting conductor, at least one of these second measurement points being distinct from the first measurement points;

determination of the value of at least one signal comparison function F over a determined time period T;

determination of the value of at least one risk indicator A identifying the risk of occurrence of an anode effect, starting from the comparison function.

46 Claims, 6 Drawing Sheets

U.S. PATENT DOCUMENTS

| | | | | |
|---|---|---|---|---|
| 4,437,950 | A * | 3/1984 | Arita et al. | 205/512 |
| 6,033,550 | A | 3/2000 | Bonnardel et al. | |
| 6,132,571 | A * | 10/2000 | Bell | 204/243.1 |
| 6,136,177 | A * | 10/2000 | Hung | 205/336 |
| 2004/0079649 | A1 * | 4/2004 | Santerre et al. | 205/336 |

FOREIGN PATENT DOCUMENTS

| | | |
|---|---|---|
| RU | 2113 552 | 4/1997 |
| SU | 1313892 | 8/1985 |
| WO | WO-OW 99/57336 | 11/1999 |

OTHER PUBLICATIONS

Database WPI, Section Ch, Week 199045, Derwent Publications Ltd., London, GB; Class M28, AN 1990-340705, XP002211087.

* cited by examiner

METHOD AND DEVICE FOR DETECTING ANODE EFFECTS OF AN ELECTROLYTIC CELL FOR ALUMINUM PRODUCTION

CROSS REFERENCE TO RELATED APPLICATIONS

This application is a 35 U.S.C. §371 National Stage Application of International Application No. PCT/FR02/04163 filed Dec. 4, 2002 which claims priority to French Application No. 01/15871 filed Dec. 7, 2001.

BACKGROUND OF THE INVENTION

1. Technical Field

This invention relates to cells for aluminium production by electrolysis of alumina dissolved in an electrolyte based on molten cryolite, particularly using the Hall-Héroult process. It relates more particularly to a device and a method for detecting anode effects.

2. State of the Art

Metal aluminium is produced industrially by fused bath electrolysis, namely electrolysis of alumina in solution in a molten cryolite bath called an electrolyte bath, according to the well-known Hall-Héroult process. The electrolyte bath is contained in pots called "electrolysis pots" comprising a steel shell that is lined with refractory and/or insulating materials on the inside, and a cathode assembly positioned at the bottom of the pot. Anodes are partially immersed in the electrolyte bath. The expression "electrolytic cell" normally denotes the assembly comprising an electrolysis pot and one or more anodes.

The electrolytic current that circulates in the electrolyte bath and the pad of liquid aluminium through anodes and cathode elements, produces aluminium reduction reactions and also maintains the electrolyte bath at a temperature of the order of 950° C. by the Joule effect. The electrolytic cell is regularly supplied with alumina so as to compensate for the consumption of alumina produced by electrolysis reactions.

One essential factor for achieving uniform operation of an aluminium production pot by electrolysis of alumina dissolved in a molten electrolyte bath based on cryolite is to maintain an appropriate content of dissolved alumina in this electrolyte and consequently to adapt quantities of alumina introduced into the bath to the consumption of alumina in the pot.

Excess alumina creates a risk of the bottom of the pot getting clogged with undissolved alumina deposits that could transform into hard plates that could electrically isolate part of the cathode. This phenomenon then causes the formation of very high horizontal electrical currents in the metal of the pots that interact with magnetic fields to stir the metal pad and cause instability at the bath-metal interface.

Conversely, a lack of alumina may in particular cause the appearance of the "anode effect", in other words polarisation of an anode with a sudden increase in the voltage at the terminals of the cell and the release of large quantities of gaseous fluorides and carbon fluorides ($CF_x$) that have a high capacity to absorb infrared rays encouraging the greenhouse effect.

Several regulation processes have been developed to control the alumina feed.

In industrial processes, it is known that an indirect evaluation of alumina contents can be used by monitoring an electrical parameter representative of the concentration of alumina in the said electrolyte. This parameter is usually the variation of the resistance R at the terminals of the pot powered at a voltage U, including a counter-electromotive force Ue for example evaluated at 1.65 Volts and through which a current I passes such that R=(U−Ue)/I. Typically, processes for regulation of the alumina content consist of modulating the alumina feed as a function of the value of R and its variation with time. Many patents have been made based on this basic principle, until very recently (for example see French application FR 2 749 858 corresponding to U.S. Pat. No. 6,033,550).

Therefore, these regulation processes provide a means of maintaining the alumina content in the bath within a narrow and small range and thus obtaining current efficiencies of the order of 95% with acid baths, by simultaneously and significantly reducing the quantity (or frequency) of anode effects on pots that are counted as the number of anode effects per pot and per day (AE/pot/day), called the "anode effect rate". This rate is between 0.15 and 0.5 AE/pot/day for the most recent electrolytic cells (that use point feed systems).

The increasingly strict requirements in terms of the emission of greenhouse effect gases are encouraging aluminium producers to search for means of further reducing anode effect rates.

Therefore the applicant has searched for economic solutions to these difficulties that could be applied on an industrial scale.

SUMMARY OF THE INVENTION

An object of this invention is a process for early detection of anode effects in an aluminium production cell based on electrolysis in molten salt, in which a first electrical voltage signal U1 and at least one second electrical voltage signal U2 are measured at two distinct locations in the said cell, and in which the value of at least one risk indicator A identifying the risk of occurrence of an anode effect (or an "anode effect early indicator" A) is determined starting from an analysis of the said signals U1, U2, . . . , that can provide an early indication that there is a high risk of the occurrence of an anode effect.

DETAILED DESCRIPTION OF A PREFERRED EMBODIMENT

Figure 1:
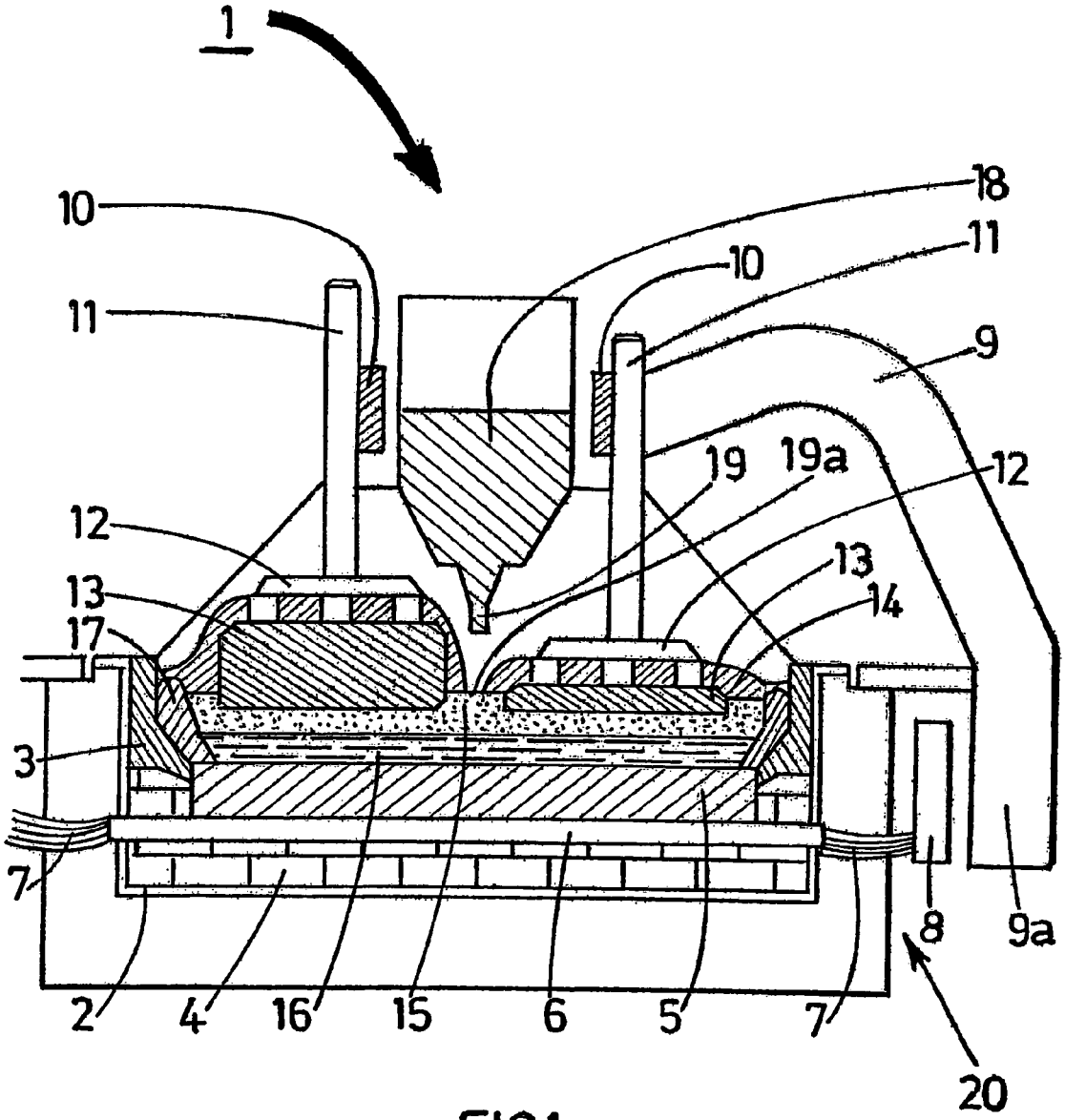
FIG. 1 shows a cross-section through a typical electrolytic cell using pre-baked anodes made of a carbonaceous material.

An anode effect early indicator A is typically determined by comparing the signals U1, U2, . . . More precisely, the indicator A (or indicators A1, A2, . . . ) is (are) typically determined from a function F (U1, U2, U3, . . . ), called the comparison function, which is preferably suitable for quantifying signal spreading and more specifically differences E between the signals U1, U2, U3, . . . .

For example, in one simplified variant of the invention, an indicator A may be given by an algebraic difference between the two electrical voltages when two voltage signals are measured, or by an algebraic difference between extreme values (for example between the signals with the greatest separation) or between at least two signals when more than two voltage signals are measured. According to another variant, an indicator A may be determined statistically, for example by a standard deviation between all signals. It may also be determined by more sophisticated analogue or digital processing.

The indicator(s) A is (are) preferably determined from the variation with time of the comparison function F (U1, U2, . . . ), typically starting from the variation with time of at least one difference E between the signals Ui (for example an algebraic difference, a standard deviation, etc.). In other words, an anode effect early indicator A may be given by an indicator B of the variation with time of the comparison function.

The applicant has observed that, surprisingly, a large proportion of anode effects begin a long time (up to several tens of minutes) before the actual occurrence of the anode effect and that this starting point corresponds to the beginning of polarization that results in a modification of the distribution of the electrical voltage in the cell, particularly close to the anode that could be polarized. The applicant also observed that voltage measurements in at least two distinct locations of an electrolytic cell are capable of reliably detecting initiation of an anode effect in advance.

Electrical voltage measurements have the advantage of being cost-effective and that they can be automated.

Another object of the invention is a process for regulating a molten salt electrolytic cell for the production of aluminium comprising the anode effect early detection process according to the invention.

Another object of the invention is a device for early detection of anode effects in an aluminium production cell by electrolysis in molten salt, capable of using the detection process according to the invention, including at least one first means of measuring a first electrical voltage signal U1 on the said cell, at least one second means of measuring at least one second electrical voltage signal U2 on the said cell, and at least one means of determining an anode effect indicator A starting from an analysis of the said electrical voltage signals U1, U2, . . . , typically starting from a comparison between the signals and possibly starting from a quantification of variations with time of the differences between them.

Another object of the invention is an electrolytic cell and a system for regulation of a molten salt electrolytic cell for the production of aluminium including an anode effect early detection device according to the invention.

The invention is advantageously applicable to an electrolytic cell (1) for the production of aluminium by electrolytic reduction of alumina dissolved in an electrolytic bath (15) based on cryolite, particularly using the Hall-Héroult electrolysis process.

As illustrated in FIG. 1, an electrolytic cell (1) for the production of aluminium by the Hall-Héroult electrolysis process typically comprises a pot (20), at least one anode (13), at least one cathode (5) and alumina feed means (18). The pot (20) comprises internal sidewalls (3) and is capable of containing a liquid electrolytic bath (15). The cell (1) can carry a so-called electrolytic current with an intensity I circulating in the said bath. The aluminium produced by the said reduction particularly forms a "liquid metal pad" (16) on the cathode(s) (5). The anodes (13) are typically supported by the attachment means (11, 12) to an anode frame (10) that may be mobile. The pot (20) normally comprises a steel shell (2), inner lining elements (3) and cathode elements (5, 6) that include connection bars (or cathode bar) (6) to which electrical conductors (7, 8) are fixed that are used to carry the electrolytic current.

Several electrolytic cells are usually arranged in series. An "electrolytic" current (for which the total intensity is Io) circulates in the cells and is distributed in them. The electrolytic current passes in the electrolyte bath (15) through the anode(s) (13) and the cathode(s) (5). It passes from one electrolytic cell to the next through connecting conductors (7 to 12) and more precisely through cathode connecting conductors (6, 7, 8) of one pot called the upstream pot, and anode connecting conductors (9, 10, 11, 12) of the next pot called the downstream pot.

The purpose of feeding the cell with alumina is to compensate for the more or less continuous consumption of the cell essentially due to the reduction of alumina into metal aluminium. The alumina feed is usually regulated independently, and consists of adding alumina into the liquid bath (15). Feed means (18) typically include crust breakers—feeders (19) that bore a hole in the alumina crust (14) and introduce a dose of alumina in the opening (19*a*) formed in the alumina crust by boring.

Aluminium metal (16) produced during the electrolysis normally accumulates at the bottom of the pot and a fairly clearly defined interface is set up between the liquid metal (16) and the bath based on molten cryolite (15). The position of this bath-metal interface varies with time; it moves up as liquid metal accumulates at the bottom of the pot and it moves down when liquid metal is extracted from the pot.

In one preferred embodiment of the invention, the anode effect early detection process in an aluminium production cell (1) based on molten salt electrolysis is characterised in that it comprises:

- measurement of a first electrical voltage signal U1 between a first cathode measurement point (301 to 304) on a cathode connecting conductor (6, 7, 8) and a first anode measurement point (311 to 314) on an anode connecting conductor (9, 10, 11, 12);
- measurement of at least one second electrical voltage signal U2 between a second cathode measurement point (301 to 304) on a cathode connecting conductor (6, 7, 8) and a second anode measurement point (311 to 314) on an anode connecting conductor (9, 10, 11, 12), at least one of these second measurement points being distinct from the said first measurement points;
- determination of the value of at least one signal comparison function F (U1, U2, . . . ) over a determined time period T;
- determination of the value of at least one risk indicator A identifying the risk of occurrence of an anode effect, starting from the said comparison function(s).

The determined time period T, which is a variable parameter for the process according to the invention, may be zero or practically zero (for example it may be equal to a sampling period Te=1/Fe). It has been found advantageous to use a sufficiently large period T to eliminate random fluctuations of the voltages Ui.

Figure 3:
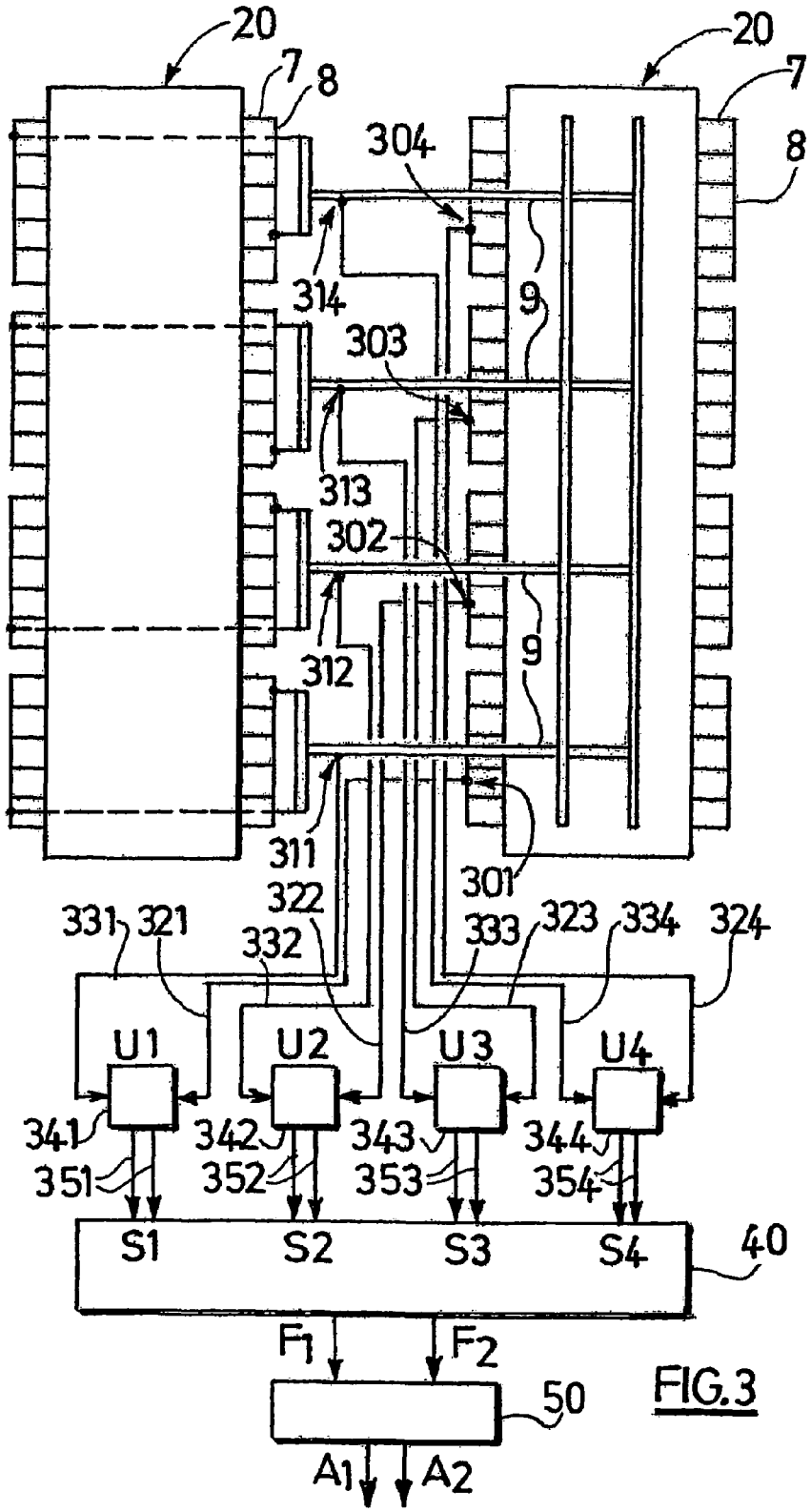
FIG. 3 diagrammatically illustrates an anode effect early detection device according to the invention.
Figure 4:
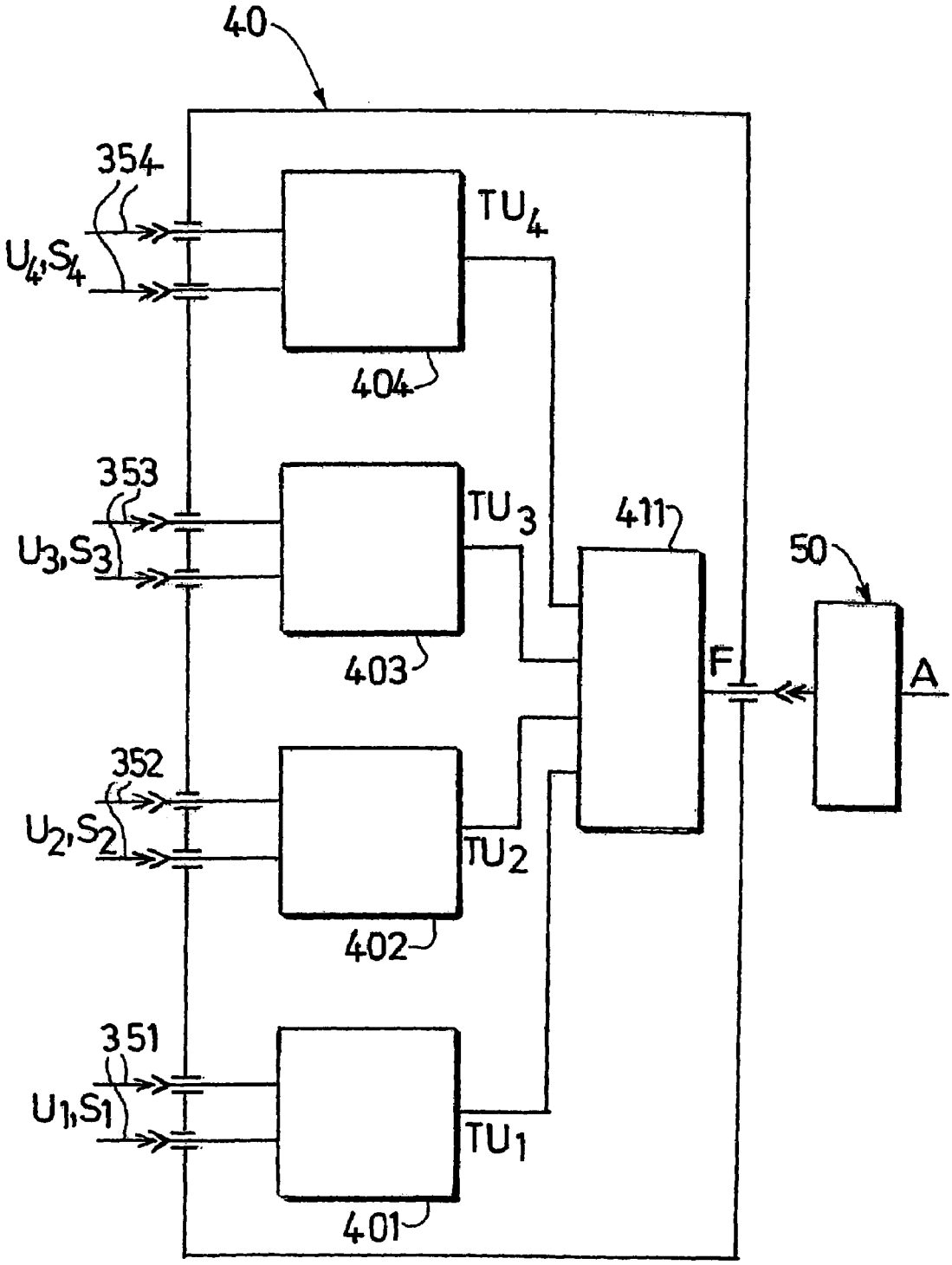
FIG. 4 diagrammatically illustrates a part of an anode effect early detection device according to the invention.

It is advantageous to include the measurement of several distinct electrical voltage signals U1, U2, U3, . . . as illustrated in FIG. 3. In other words, the detection process according to the invention comprises the measurement of N electrical voltage signals Ui, where N is advantageously more than 2. The use of several signals can increase the reliability of early detection and more precisely determine the position of the area of the pot in which an anode effect may occur. In this way, the anode effect preventive treatment may for example include a local modification of the alumina feed (typically within the area detected by the measurements).

In the detection process according to the invention, the said electrical voltage signals Ui (in other words U1 U2, U3, . . . Un) are usually measured as a function of time. They are typically measured analogically, and are then converted into digital signals for processing.

The comparison function F (U1, U2, . . . ) may be given by an equivalent function F' (TU1, TU2, . . . ) that uses pre-processed signals (TU1, TU2, . . . ) as arguments, in other words signals TU1, TU2, . . . derived from pre-processing of the signals U1, U2, . . . . Typically, the pre-processing includes sampling of the real signals U1, U2, . . . at a determined frequency Fe, and possibly one (or more) additional processing operations on at least one of the signals. These operations are typically chosen from among frequency filtering operations (low-pass, band-pass or other), sub-sampling, calculation of at least one average (such as an RMS (Root Mean Square), possibly sliding, that can be calculated using the relation $Urms=\sqrt{(\Sigma(Ui(j)-Ur)^2/m)}$, where Ui(j) is a value of the voltage Ui at time j, Ur is a reference value, possibly zero, and m is the number of terms in the sum; the same relation may be used for calculating an average TUrms on the pre-processed signals TUi) and known mathematical operations (such as the calculation of a difference between each signal Ui or pre-processed signal TUi and a reference value Uo that may be an average Um of the signals Ui or the pre-processed signals TUi). These operations can be combined. An anti-aliasing low-pass filter is advantageously included in the pre-processing. The signals may be processed analogically and/or digitally. Only some signals Ui may also be pre-processed.

There may be several different types of frequency filtration operation. It has been found advantageous to use a low-pass type filter. The filter cut-off frequency is advantageously between 0.001 and 1 Hz.

It has also been found advantageous to use a band-pass type filter. Low cut-off and high cut-off frequencies of the band-pass type frequency filter are advantageously between 0.001 and 1 Hz and between 1 and 10 Hz (typically 0.5 and 5 Hz) respectively.

In one embodiment of this variant, the pre-processing comprises two frequency filtrations, one of the low-pass type (with a cut-off frequency typically equal to about 0.5 Hz) that gives a first pre-processed signal TUi, and the other of the band-pass type (with a low cut-off frequency typically equal to about 0.5 Hz, and a high cut-off frequency typically equal to about 5 Hz) that gives a second pre-processed signal TUi'. In this embodiment, the process comprises two comparison functions F, one applicable to TUi signals and the other applicable to TUi' signals.

In another embodiment of this variant, the pre-processing comprises three frequency filtrations; a first of the low-pass type (with a cut-off frequency typically equal to about 0.003 Hz) that gives a first pre-processed signal TUi, a second of the band-pass type (with a low cut-off frequency typically equal to about 0.003 Hz and a high cut-off frequency typically equal to about 0.5 Hz) that gives a second pre-processed signal TUi', and a third of the band-pass type (with a low cut-off frequency typically equal to about 0.5 Hz and a high cut-off frequency typically equal to about 5 Hz) that gives a third pre-processed signal TUi". In this embodiment, the process includes three comparison functions F, the first applicable to TUi signals, the second applicable to TUi' signals, and the third applicable to TUi" signals.

In one advantageous embodiment of the invention, the said at least one comparison function F(U1, U2, . . . ) (or possibly F'(TU1, TU2, . . . )) is given by a difference E between the said signals (U1, U2, U3, . . . ) or between the pre-processed signals (TU1, TU2, . . . ). In particular, the comparison function F(U1, U2, . . . ) may be given by a difference E between at least two voltage signals U1, U2, . . . , or between at least two pre-processed voltage signals TU1, TU2 . . . . The difference E may be given by an algebraic difference between the signals Ui or pre-processed signals TUi, for example by the largest difference between all signals Ui or pre-processed signals TUi (typically the difference between the signals with the greatest separation, at a given time, or over a given time period). The difference E may also be given by a standard deviation between the signals Ui or pre-processed signals TUi.

At least one anode effect early indicator A may be equal to a comparison function F(U1, U2, . . . ) or F'(TU1, TU2, . . . ).

The value of at least one indicator A of the risk of occurrence of an anode effect may also be determined from variations with time of the said comparison function(s) F or F'. These variations may be given by an indicator B of the variation with time of a comparison function F(U1, U2, . . . ) or F'(TU1, TU2, . . . ). In one simplified variant of this embodiment, the comparison function F(U1, U2, . . . ) is given by a difference E between at least two voltage signals U1, U2, . . . or between at least two pre-processed voltage signals TU1, TU2, . . . , and the variation indicator B may be proportional to the difference between the value E(t) of a difference E at time t and its value E(t-to) at time t-to, where to is an adjustable parameter.

The indicator A may signal a severe risk of occurrence of an anode effect when its value is greater than a given threshold value S. Typically, the process signals this severe risk when the value of a difference E (and more generally E(t)) is more than a given threshold value Se or when the variation of the value of the comparison function F or F' is greater than a given threshold value St.

In one advantageous embodiment of the invention, the detection process also comprises a test operation that can reveal the susceptibility of an electrolytic cell to the initiation of an anode effect. This test operation typically comprises a temporary reduction in the rate of feed of alumina to the cell (corresponding to under-feed of alumina), this reduction typically being between 20 and 100% of the average feed rate (100% representing a complete stoppage of the alumina feed). For example, tests carried out by the applicant have shown that a temporary reduction in the feed rate of alumina to the cell, or even a temporary stoppage of this feed, can significantly increase the spread of voltages Ui or pre-processed voltages TUi when the cell is in a high risk state, with respect to the occurrence of an anode effect.

The regulation process according to the invention advantageously comprises a preventive anode effect treatment operation that can eliminate anode effects that are detected in advance, and that can be activated when an anode effect has been detected in advance. This operation is normally triggered as a function of the value of the function F (or F'), typically when a difference between at least two signals Ui or between at least two pre-processed signals TUi exceeds a given threshold Se, or when the variation of this difference with time exceeds a given threshold St.

The preventive treatment typically comprises a modification to the position of the anode(s) with respect to the cathode(s), an excess feed of alumina compared with the normal feed rate, or a combination of these operations.

The regulation process advantageously takes account of operating procedures that could result in disturbed values for the function F (or F') and therefore for the indicator(s) A, such as anode changes.

In order to enable preventive treatment of an anode effect, the cell (1) advantageously comprises at least one adjustment means such as a mobile anode frame (10) to which the anode(s) (13) is (are) fixed or a means of controlling the alumina feed means (18, 19).

Advantageously, the regulation process also comprises:

measurement of at least one voltage signal UA on at least one cell on the upstream and/or downstream side;

comparison between the signal(s) UA and the signals U1, U2, . . . (or the pre-processed signals TU1, TU2, . . . ) so as to subtract fluctuations (or noise) from neighbouring cells, and possibly from the entire series of electrolytic cells, from the signals U1, U2, . . . , or from the pre-processed signals TU1, TU2.

According to another variant of the invention, the regulation process also comprises:

measurement of at least one electrolytic current intensity signal I;

comparison between the signal(s) I and signals U1, U2, . . . (or pre-processed signals TU1, TU2, . . . ) so as to subtract fluctuations (or noise) common to all electrolytic cells, from the signals U1, U2, . . . or from the pre-processed signals TU1, TU2 . . . .

The intensity I is typically the total intensity Io circulating in the cells. The intensity I of other currents circulating in a series of electrolytic cells could also be used, such as the current circulating in an anode, in a connecting conductor or in a cathode bar.

In particular, this variant of the invention can reduce the "signal/noise" ratio.

According to one preferred embodiment of the invention, the device for early detection of an anode effect in an aluminium production cell by molten salt electrolysis is characterised in that it comprises:

at least one first means (321 to 344) of measuring a first electrical voltage signal Ul between a first cathode measurement point (301 to 304) on a cathode connecting conductor (6, 7, 8) and a first anode measurement point (311 to 314) on an anode connecting conductor (9, 10, 11, 12);

at least one second means (321 to 344) of measuring a second electrical voltage signal U2 between a second cathode measurement point (301 to 304) on a cathode connecting conductor (6, 7, 8) and a second anode measurement point (311 to 314) on an anode connecting conductor (9, 10, 11, 12), at least one of these second measurement points being distinct from the said first measurement points;

at least one means (351–354, 40) of determining the value of at least one signal comparison function F(U1, U2, . . . ) or F'(TU1, TU2, . . . ) over a determined time period T;

at least one means (50) of determining the value of at least one risk indicator A identifying a risk of occurrence of an anode effect starting from the function(s) F or F'.

The device may also comprise a means of determining the value of at least one risk indicator A identifying a risk of occurrence of an anode effect starting from variations with time of the said comparison function(s) F or F'.

The measurement means of the electrical voltage signals U1, U2, . . . advantageously comprise electrical conductors (32, 321, 322, 323, 324, . . . , 33, 331, 332, 334, . . . )—typically in the form of wires or cables—with one end connected to a measurement point (30, 301, 302, 303, 304, . . . , 31, 311, 312, 313, 314, . . . ) on the cell and the other end connected to voltage measurement means (34, 341, 342, 343, . . . ) such as a voltmeter. The electrical voltage measurement points (30, 301, . . . , 31, 311, . . . ) may be made by any known means such as screw fasteners, notching, etc.

Some voltage measurement means (30, 31, 32, 33, 34, . . . ) may be fixed permanently on the cell. They are advantageously installed on fixed parts of the cell such as fixed conductors (7, 8, 9, 10) which, in particular, avoid measurement interruptions and re-installation of measurement means during anode changes.

Figure 2:
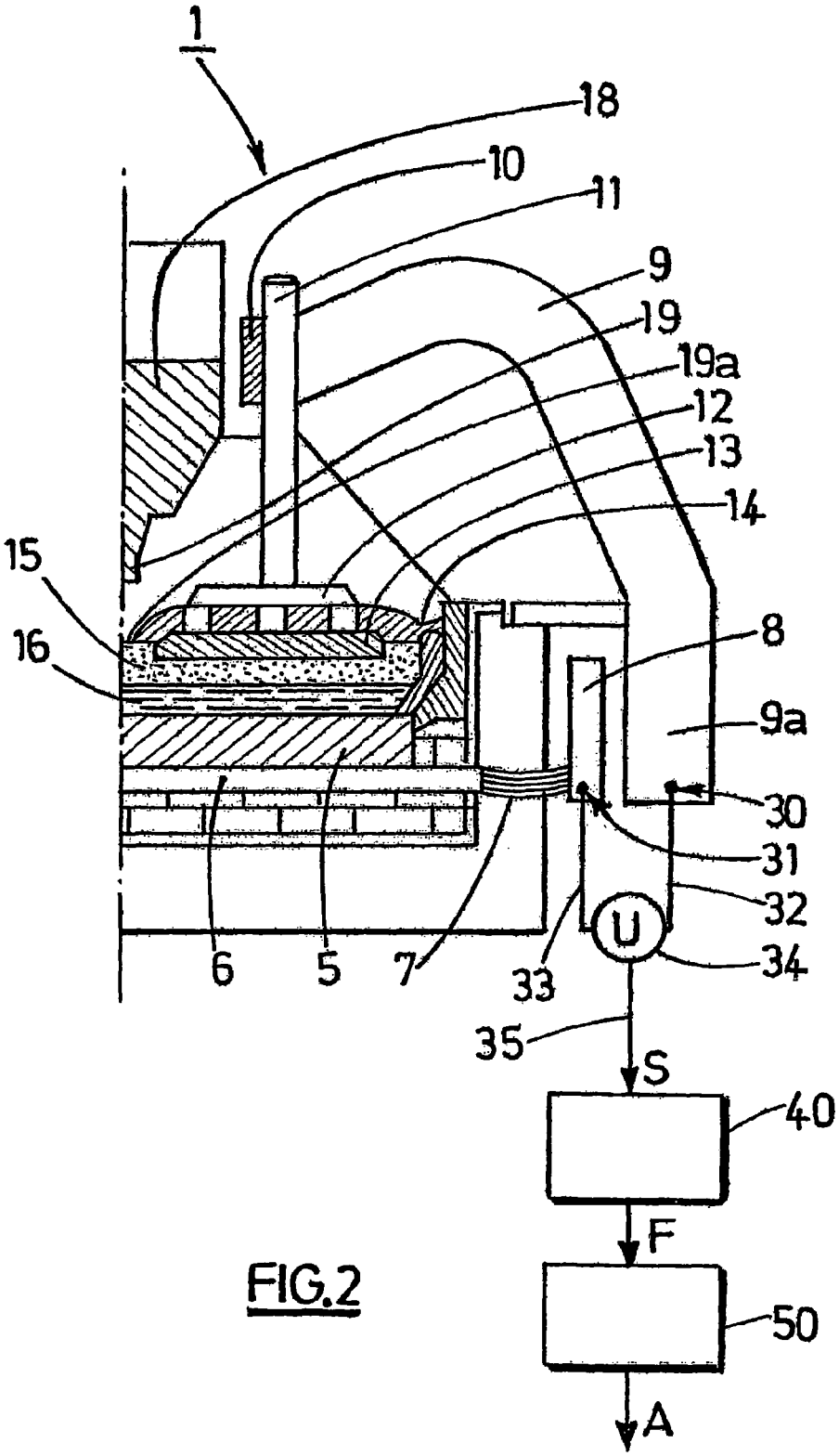
FIG. 2 illustrates a method of measuring the voltage at the terminals of an electrolytic pot according to the invention.

The said electrical voltage signals U1, U2, U3, . . . are advantageously measured between a collector (8) and a riser (9), preferably in the lower part (9*a*) of the said riser (as illustrated in FIG. 2), which in particular simplifies the wiring (32, 321, 322, . . . , 33, 331, . . . ) and facilitates access to measurement points (30, 301, . . . , 31, 311, . . . ).

The signals S (S1, S2, . . . ) generated by measurement means (34, 341, 342, . . . ) that are equivalent to voltage signals U1, U2, . . . , are transmitted to an analyser or a comparator (40) through transmission means (35, 351, 352, 353, 354, . . . ) such as electrical conductors, radio waves, optical means or any other means.

The means (351–354, 40) of evaluating at least one comparison function F (or F') for comparing the said voltage signals Ui advantageously comprise at least one pre-processing means (401–404) for pre-processing at least one of the signals Ui or equivalent signals Si. The pre-processing means typically comprise at least one frequency filter, and advantageously a low-pass or band-pass filter. The means of pre-processing may also be a means of sampling the signals U1, U2 at a determined frequency Fe. In practice, it may also include one or more elements typically chosen from among analogue/digital converters (ADC), amplifiers (G), frequency filters (low-pass, band-pass or other), sub-samplers, means of calculating an average on a signal (RMS or other type), means of calculating an average Um of at least one signal Ui or several signals Ui, and known mathematical operators (such as means of subtracting a reference value Uo and more precisely of calculating a difference between each signal U1, U2, . . . or pre-processed signal TU1, TU2, . . . , and a reference value Uo, where Uo is typically an average Um). When the device comprises a low-pass filter, the cut-off frequency of the low-pass filter is typically between 0.001 and 1 Hz. When the device comprises a band-pass filter, the low and the high cut-off frequencies of the band-pass filter are typically between 0.001 and 1 Hz and between 1 and 10 Hz, respectively. The device may also comprise a means of determining an average value Um of the signals U1, U2, . . . , or pre-processed signals TU1, TU2, . . . .

The device may also comprise a means (40, 411) of determining a difference E (and more generally E(t)) (such as an algebraic difference, a standard deviation, etc.) between at least two voltage signals U1, U2, . . . or between at least two pre-processed voltage signals TU1, TU2, . . . .

The device may also comprise a means of determining a variation with time of at least one signal comparison function F(U1, U2, . . . ) or F' (TU1, TU2, . . . ), such as a variation with time of a difference E (and more precisely E(t)) between at least two voltage signals U1, U2, . . . , or between at least two pre-processed voltage signals TU1, TU2, . . . .

The means of evaluating a function F (or F') (40, 401, . . . , 404, 411) and of determining an anode effect indicator A (50) may advantageously be grouped into a single means, typically using an electronic circuit and/or common data processing means.

Advantageously, the system for regulation of an electrolytic cell according the invention also comprises:

a means of measuring at least one voltage signal UA on at least one cell on the upstream side and/or the downstream side;

a means of comparing the signal(s) UA and the signals U1, U2, . . . (or the pre-processed signals TU1, TU2, . . . ) so as to subtract fluctuations (or noise) from neighbouring cells, and possibly from the entire series of electrolytic cells, from these signals.

According to another variant of the invention, the regulation system also comprises:

a means of measuring at least one electrolytic current intensity signal I (typically the total intensity Io circulating in the cells);

a means of comparing the signal(s) I and the signals U1, U2, . . . (or the pre-processed signals TU1, TU2, . . . ) so as to subtract the fluctuations (or noise) common to all electrolytic cells from these signals.

EXAMPLES

Electrical voltage and current measurements were made on an electrolytic pot in which a current with a total intensity of about 500 kA was circulating. The measures were spread over several weeks. Six voltage signals Ui were measured at 6 different locations in the pot, between anode measurement points and distinct cathode measurement points. The current circulating in the six distinct anodes was also measured as a function of time.

Figure 5:
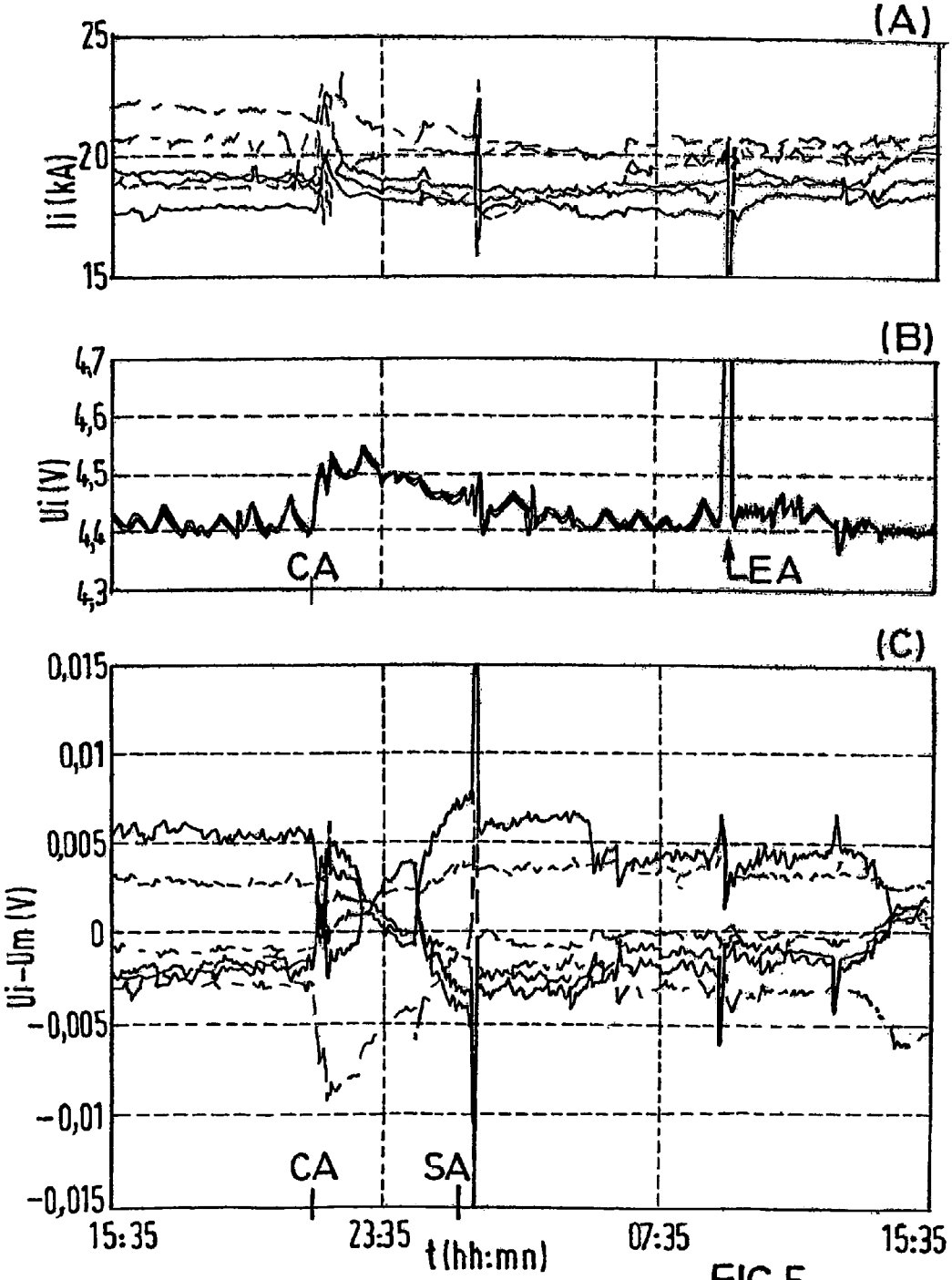
FIGS. 5 and 6 show voltage and current signals measured according to the invention on an electrolytic cell.
Figure 6:
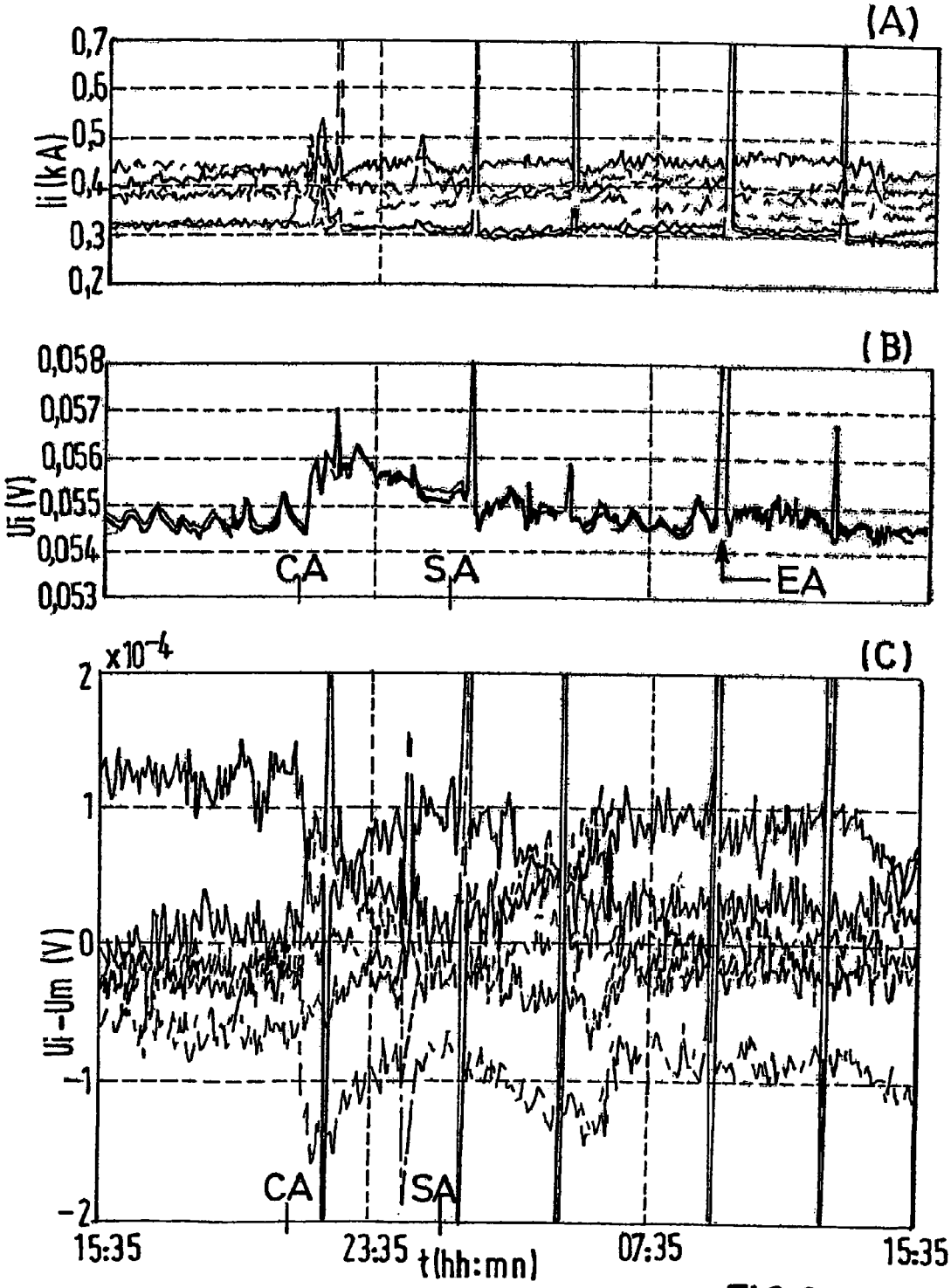

FIGS. 5 and 6 show the results obtained during a 24-hour period during which an anode effect (denoted AE) was observed. FIG. 5 corresponds to the current signals Ii (graph A) and voltage signals Ui (graph B) as a function of the time t, digitised and pre-processed using a low-pass filter with a cut-off frequency of 0.5 Hz. FIG. 6 corresponds to the same digitised signals, but pre-processed using a band-pass filter with cut-off frequencies equal to 0.5 Hz and 5 Hz. In both figures, the graph C gives the difference between each filtered voltage signal Ui and the average Um of the 6 filtered voltage signals. The letters CA identify the moment at which an anode was changed.

A progressive increase in signal spreading was observed several tens of minutes before an anode effect (denoted AE in the figures) (particularly for signals filtered in low-pass). One or more anodes started to be partially polarized, with polarisation areas increasing relatively slowly.

FIG. 5 shows that spreading of signals filtered in low-pass increased gradually before the polarization events. In particular, spreading increased significantly (from 9 mV to more than 30 mV) starting 90 minutes before strong polarization observed after the temporary cut-off of the alumina feed (denoted SA in FIG. 5). Similarly, spreading increased significantly (from 7.5 mV to 12 mV) starting 30 minutes before the anode effect denoted AE in FIG. 5. The comparison function could then be given by the largest difference between two signals Ui-Um.

An increase in signal spreading was also observed during an anode change (denoted CA in FIG. 5). In this case, the increase took place immediately (changing quickly from 8.5 mV to 15 mV). These observations can be used to correct anode effect risk indicators to overcome these known disturbances and in particular disturbances related to operations on the pot or to some specific regulation procedures.

FIG. 6 can be helpful for making another diagnostic on the behaviour of signals filtered in band-pass. An increase in the spreading was also observed (which increased from 0.2 mV to more than 0.4 mV in this case) in anode effect risk situations.

A combination of this information may also be used to generate synthetic anode effect risk indicators for reliable early detection of anode effects and to apply treatments that could avoid these effects.

LIST OF NUMERIC MARKS (1) electrolytic cell
(2) shell
(3) inner lining (inner sidewall)
(4) inner lining (refractory bricks)
(5) cathode
(6) connecting bar or cathode bar
(7) cathode connecting conductor
(8) cathode connecting conductor (collector)
(9) anode connecting conductor (riser)
(9*a*) lower part of a riser
(10) anode frame
(11) support and attachment for an anode (anode stem)
(12) anode support means
(13) anode
(14) alumina cover (or crust)
(15) electrolyte bath
(16) liquid metal pad
(17) solidified bath layer
(18) alumina feed means
(19) crust breaker-feeder
(19*a*) opening in the alumina crust
(10) pot
(30) (301) (302) . . . (31) (311) (312) . . . electrical voltage measurement points
(32)(321)(322)(323) . . . (33)(331)(332)(333) . . . electrical conductor
(34) (341) (342) (343) . . . electrical voltage measurement means
(35) (351) (352) (353) . . . transmission means
(40, 401, . . . , 404, 411) means of evaluating a comparison function F
(50) means of determining an anode effect indicator A.

The invention claimed is:

1. Process for early detection of an anode effect in an aluminum production cell based on molten salt electrolysis, said cell comprising at least one anode, at least one cathode and cathode connecting conductors and anode connecting conductors, wherein said process comprises:

measurement of a first electrical voltage signal U1 between a first cathode measurement point on a cathode connecting conductor and a first anode measurement point on an anode connecting conductor;

measurement of at least one second electrical voltage signal U2 between a second cathode measurement point on a cathode connecting conductor and a second anode measurement point on an anode connecting conductor, at least one of these second measurement points being distinct from the said first measurement points;

determination of a value of at least one signal comparison function F over a determined time period T;

determination of a value of at least one risk indicator A identifying the risk of occurrence of an anode effect, starting from said comparison function.

2. Detection process according to claim 1, wherein the function F is given by an equivalent function F' that uses signals, . . . as arguments derived from pre-processing of signals.

3. Detection process according to claim 2, wherein the pre-processing comprises sampling the electrical voltage signals at a determined frequency Fe.

4. Detection process according to claim 2, wherein the pre-processing comprises a frequency filtration operation of at least one of said electrical voltage signals.

5. Detection process according to claim 4, wherein the frequency filtration operation is of the low-pass type.

6. Detection process according to claim 5, wherein the cut-off frequency of the low-pass type frequency filtration operation is between 0.001 and 1 Hz.

7. Detection process according to claim 4, wherein the frequency filtration operation is of band-pass type.

8. Detection process according to claim 7, wherein the low cut-off and high cut-off frequencies of the band-pass type frequency filtration operation are between 0.001 and 1 Hz and between 1 and 10 Hz respectively.

9. Detection process according to claim 2, wherein the pre-processing comprises at least one sub-sampling.

10. Detection process according to claim 2, wherein the pre-processing comprises the calculation of at least one average of at least one signal Ui.

11. Detection process according to claim 10, wherein the average is an RMS average.

12. Detection process according to claim 2, wherein the pre-processing comprises the calculation of a difference between each signal Ui or pre-processed signal TUi and a reference value Uo.

13. Detection process according to claim 12, wherein the reference value Uo is an average Um of the signals Ui or the pre-processed signals TUi.

14. Detection process according to claim 1, wherein the comparison function F is given by a difference E between at least two voltage signals, or between at least two preprocessed voltage signals.

15. Detection process according to claim 14, wherein the difference E is given by an algebraic difference between the signals Ui or pre-processed signals TUi.

16. Detection process according to claim 14, wherein the difference E is given by a standard deviation between the signals Ui or the pre-processed signals TUi.

17. Detection process according to claim 1, wherein at least one indicator A is equal to a comparison function F or F'.

18. Detection process according to claim 1, wherein at least one indicator A is given by an indicator B of the variation with time of a comparison function F or F'.

19. Detection process according to claim 18, wherein the comparison function F is given by a difference E between at least two voltage signals or between at least two pre-processed voltage signals, and wherein the variation indicator B is proportional to the difference between the value E(t) of a difference E at time t and its value E(t−to) at time t−to, where to is an adjustable parameter.

20. Detection process according to claim 17, wherein the indicator A signals a severe risk of occurrence of an anode effect when a value of said indicator A is greater than a given threshold value.

21. Process according to claim 1, wherein said process comprises a test operation that can reveal the susceptibility of an electrolytic cell to initiation of an anode effect.

22. Process according to claim 21, wherein the test operation comprises a temporary reduction in the rate of feed of alumina to the cell.

23. Detection process according to claim 1, wherein said process comprises the measurement of N electrical voltage signals Ui, where N is more than 2.

24. Process for regulation of an electrolytic cell, wherein said process comprises the anode effect detection process according to claim 1.

25. Regulation process according to claim 24, wherein said process further comprises an anode effect preventive treatment.

26. Regulation process according to claim 25, wherein the preventive treatment comprises an operation selected from the group consisting of (i) a modification to the position of an anode with respect to a cathode, (ii) an excess feed of alumina compared with a normal feed rate, and (iii) a combination of (i) and (ii).

27. Regulation process according to claim 24, wherein said process further comprises:

measurement of at least one voltage signal UA on at least one cell on an upstream and/or downstream side;

comparison between the signal UA and the electrical voltage signals or the pre-processed signals so as to subtract fluctuations from neighboring cells, and optionally from an entire series of electrolytic cells, from the electrical voltage signals, or from the pre-processed signals.

28. Regulation process according to claim 24, further comprising:

measurement of at least one electrolytic current intensity signal I;

comparison between the signal I and the electrical voltage signals or pre-processed signals so as to subtract fluctuations common to all electrolytic cells, from the electrical voltage signals or from the pre-processed signals.

29. Device for early detection of an anode effect in an aluminum production cell based on electrolysis in molten salt, capable of using the detection process according to claim 1, said cell comprising at least one anode, at least one cathode and cathode connecting conductors, and anode connecting conductors, wherein said device comprises:

at least one first means of measuring a first electrical voltage signal U1 between a first cathode measurement point on a cathode connecting conductor and a first anode measurement point on an anode connecting conductor;

at least one second means of measuring a second electrical voltage signal U2 between a second cathode measurement point on a cathode connecting conductor and a second anode measurement point on an anode connecting conductor, at least one of said second measurement points being distinct from the said first measurement points;

at least one means of determining the value of at least one signal comparison function F or F' over a determined time period T;

at least one means of determining the value of at least one risk indicator identifying a risk of occurrence of an anode effect A starting from the function F or F'.

30. Device according to claim 29, wherein the means of evaluating the value of at least one function F of voltage signals comprises at least one means of pre-processing at least one of the signals.

31. Device according to claim 30, wherein the pre-processing means comprises a means of sampling said electrical voltage signals, at a determined frequency Fe.

32. Device according to claim 30, wherein the pre-processing means comprises a frequency filter.

33. Device according to claim 32, wherein the frequency filter is a low-pass filter.

34. Device according to claim 33, wherein the cut-off frequency of the low-pass filter is between 0.001 and 1 Hz.

35. Device according to claim 32, wherein the frequency filter is a band-pass filter.

36. Device according to claim 35, wherein the low cut-off and high cut-off frequencies of the band-pass filter are between 0.001 and 1 Hz and between 1 and 10 Hz respectively.

37. Device according to claim 30, wherein the pre-processing means comprises at least one means of sub-sampling said electrical voltage signals.

38. Device according to claim 30, wherein the pre-processing means comprises at least one means of calculating an average of at least one signal Ui or several signals Ui.

39. Device according to claim 30, wherein the pre-processing means comprises a means of calculating a difference between each electrical voltage signal, or pre-processed signal and a reference value Uo.

40. Device according to claim 39, wherein said device further comprises a means of determining an average value Um of said electrical voltage signals or pre-processed signals.

41. Device according to claim 29, wherein said device further comprises a means of determining a difference E between at least two voltage signals or between at least two pre-processed voltage signals.

42. Device according to claim 29, wherein said device comprises a means of determining a variation with time of at least one signal comparison function F.

43. Electrolytic cell based on molten salt for aluminum production, wherein said cell comprises an anode effect detection device according to claim 29.

44. System for regulation of an electrolytic cell based on molten salt for aluminum production, wherein said system comprises an anode effect early detection device according to claim 29.

45. Regulation system according to claim 44, wherein said system further comprises:

a means of measuring at least one voltage signal UA on at least one cell on an upstream side and/or a downstream side thereof;

a means of comparing the signal UA and the electrical voltage signals or pre-processed signals so as to subtract fluctuations from neighboring cells, and optionally from an entire series of electrolytic cells, from voltage signals or from pre-processed signals.

46. Regulation system according to claim 44, wherein said system further comprises:

a means of measuring at least one electrolytic current intensity signal I;

a means of comparing the signal I and the electrical voltage signals or the pre-processed signals so as to subtract fluctuations common to all electrolytic cells from the electrical voltage signals or the pre-processed signals.

* * * * *